US007789709B1

(12) United States Patent
He et al.

(10) Patent No.: US 7,789,709 B1
(45) Date of Patent: Sep. 7, 2010

(54) CARD CONNECTOR

(75) Inventors: Hang-Xiao He, Tu-Cheng (TW); Wei-Hong Liao, Tu-Cheng (TW); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/585,071

(22) Filed: Sep. 2, 2009

(51) Int. Cl.
*H01R 24/00* (2006.01)

(52) U.S. Cl. ..... 439/630; 200/51.09

(58) Field of Classification Search ..... 439/157, 439/159, 160, 607, 630; 200/51.09, 51.1
See application file for complete search history.

(56) References Cited

U.S. PATENT DOCUMENTS 6,890,195 B2 * 5/2005 Nagata ..... 439/159
7,008,245 B1 * 3/2006 Chien ..... 439/159
7,484,976 B2 * 2/2009 Ezaki ..... 439/159
7,507,098 B1 * 3/2009 Hung ..... 439/159
7,544,097 B2 * 6/2009 Hong et al. ..... 439/626
7,588,467 B2 * 9/2009 Chang ..... 439/630
2009/0191746 A1 * 7/2009 Ma et al. ..... 439/350

* cited by examiner

*Primary Examiner*—Thanh-Tam T Le
(74) *Attorney, Agent, or Firm*—Cheng-Ju Chiang

(57) ABSTRACT

A card connector includes an insulating housing and a plurality of conductive terminals disposed in the insulating housing. The insulating housing has a base board, a first lateral wall and a second lateral wall extended upwards from two opposite sides of the base board, and a preventing wall extended upwards from a rear end of the base board, with a receiving formed thereamong. A monitoring assembly disposed in the insulating housing has a first monitoring member and a second monitoring member. The first monitoring member fixed in the receiving chamber adjacent to the second lateral wall has an elastic portion. The second monitoring member mounted in the preventing wall has a contacting portion located at an outer side of the elastic portion, with a gap formed therebetween. The elastic portion is pressed laterally by the fully inserted card and deflects elastically to connect with the contacting portion.

20 Claims, 6 Drawing Sheets

CARD CONNECTOR

BACKGROUND OF THE INVENTION

1. Field of the Invention

The present invention relates to a card connector, and more particularly to a card connector capable of monitoring whether a card is fully inserted therein.

2. The Related Art

With the development of electronic technology, more and more electronic products, such as digital cameras, personal digital assistants (PDA) and mobile phones etc, are equipped with card connectors for receiving various electronic cards to achieve multiple functions. The conventional card connector includes an insulating housing, a plurality of conductive terminals received in a receiving recess of the insulating housing, and a monitoring assembly. Generally speaking, the monitoring assembly has two monitoring members positioned at a side of the receiving recess side by side. When the electronic card is fully inserted into the receiving recess, one of the monitoring members will be pushed to connect with the other one, for informing that the electronic card is fully inserted into the receiving recess. Nevertheless, since the conventional monitoring assembly is located at one side of the receiving recess, the insulating housing has to leave a relative larger space for mounting the monitoring assembly, which enlarges the volume of the insulating housing and is against the development trend of the electronic product miniaturization. So it is desirable to design a monitoring assembly mounted to the card connector with a small occupied space.

SUMMARY OF THE INVENTION

An object of the present invention is to provide a card connector adapted for receiving a card therein. The card connector includes an insulating housing and a plurality of conductive terminals disposed in the insulating housing and contacting the card. The insulating housing has a base board, a first lateral wall and a second lateral wall extended upwards from two opposite sides of the base board, and a preventing wall extended upwards from a rear end of the base board. A receiving chamber is formed among the first lateral wall, the second lateral wall and the preventing wall for receiving the card. A monitoring assembly disposed in the insulating housing has a first monitoring member and a second monitoring member. The first monitoring member is fixed in the receiving chamber adjacent to the second lateral wall and has an elastic portion of substantially smooth V shape, with a point back to the second lateral wall for resting against a side of the inserted card. The second monitoring member is mounted in the preventing wall has a contacting portion extending parallel to the second lateral wall and located at an outer side of the elastic portion, with a gap formed therebetween. The elastic portion is pressed laterally by the fully inserted card and deflects elastically to connect with the contacting portion.

As described above, the first monitoring member is arranged in the receiving chamber adjacent to the second lateral wall. The second monitoring member mounted in the preventing wall has the contacting portion extending parallel to the second lateral wall for elastically abutting against the elastic portion of the first monitoring member. Such arrangements save an occupied space of the insulating housing, consequently, reduce the volume of the card connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
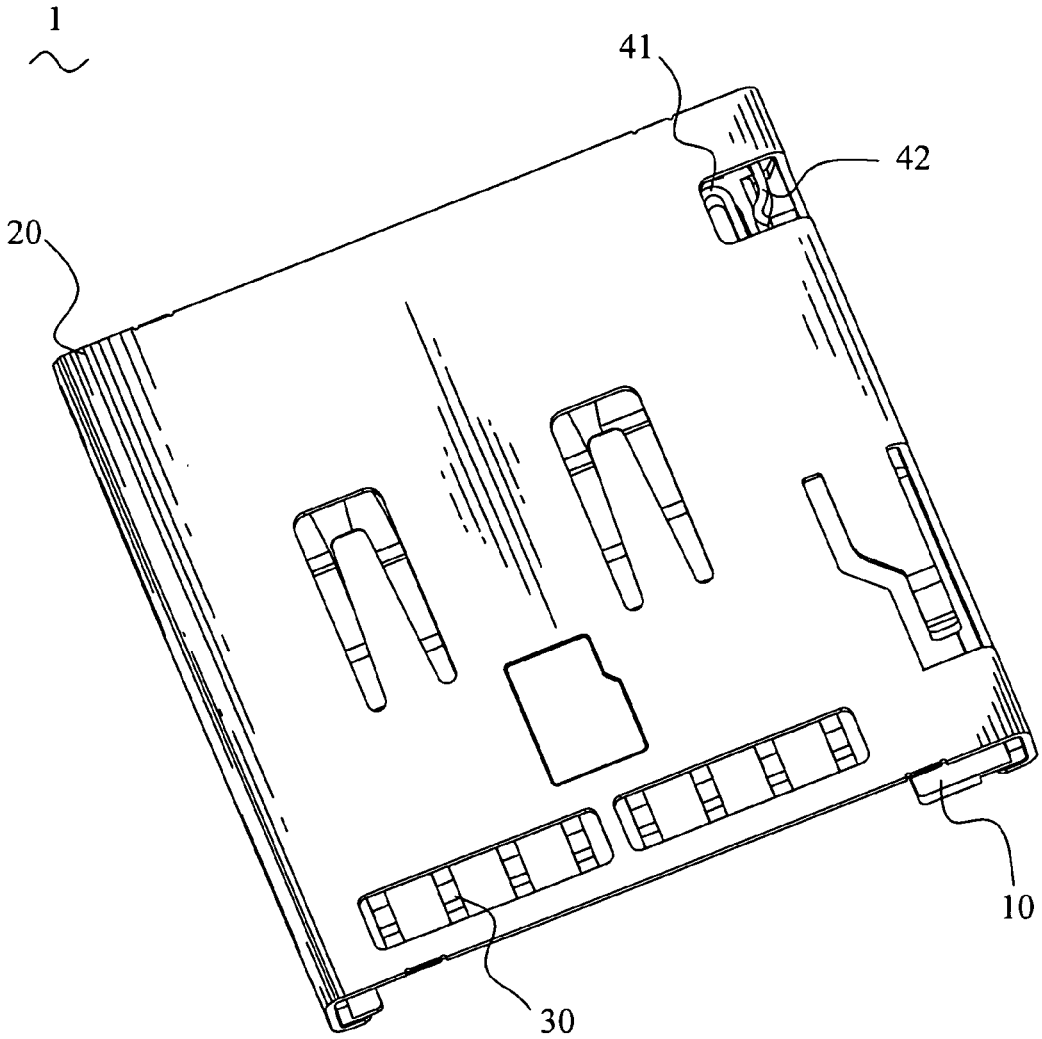
FIG. 1 is an assembled perspective view of a card connector in accordance with the present invention.
Figure 2:
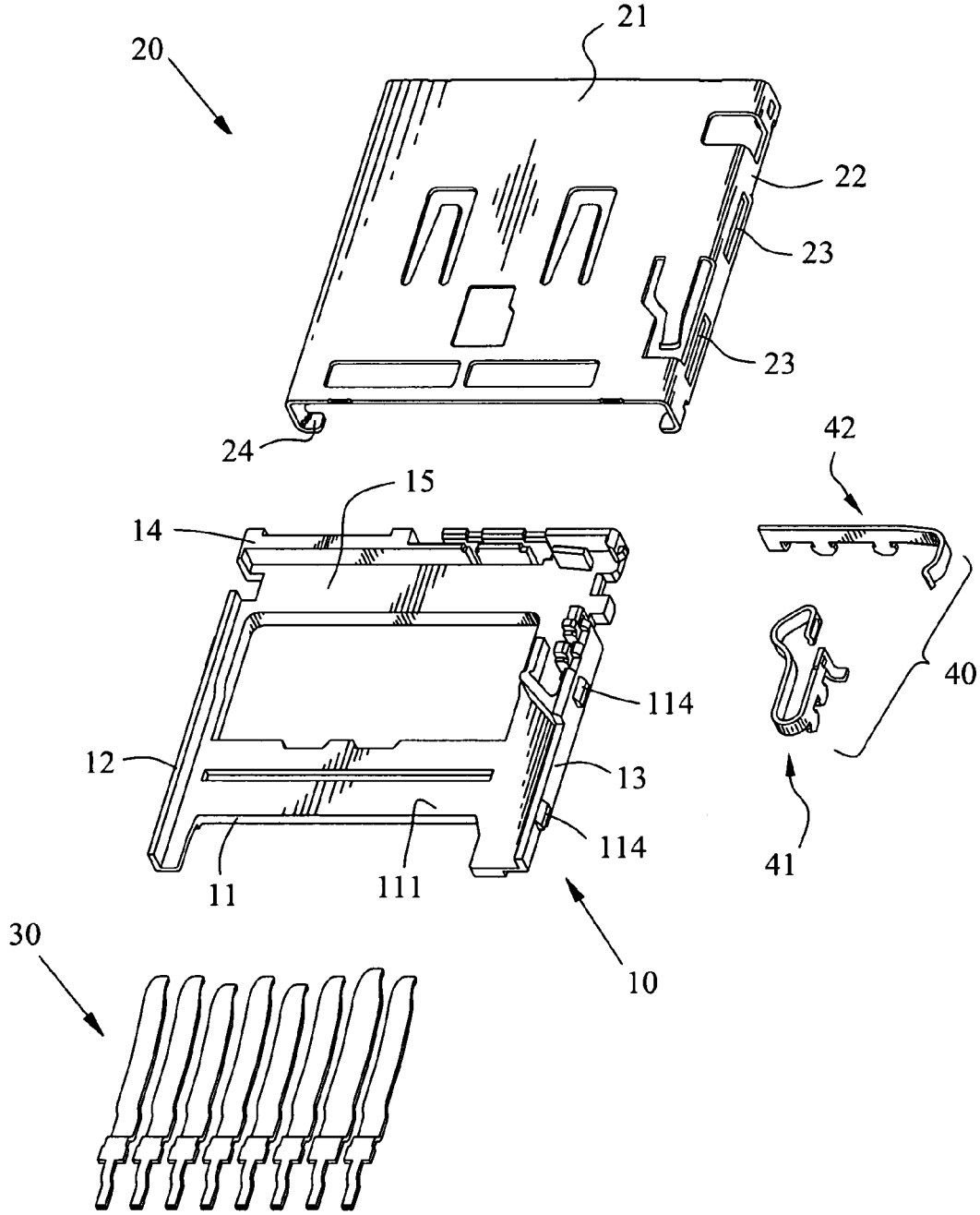
FIG. 2 is an exploded perspective view of the card connector shown in FIG. 1.
Figure 3:
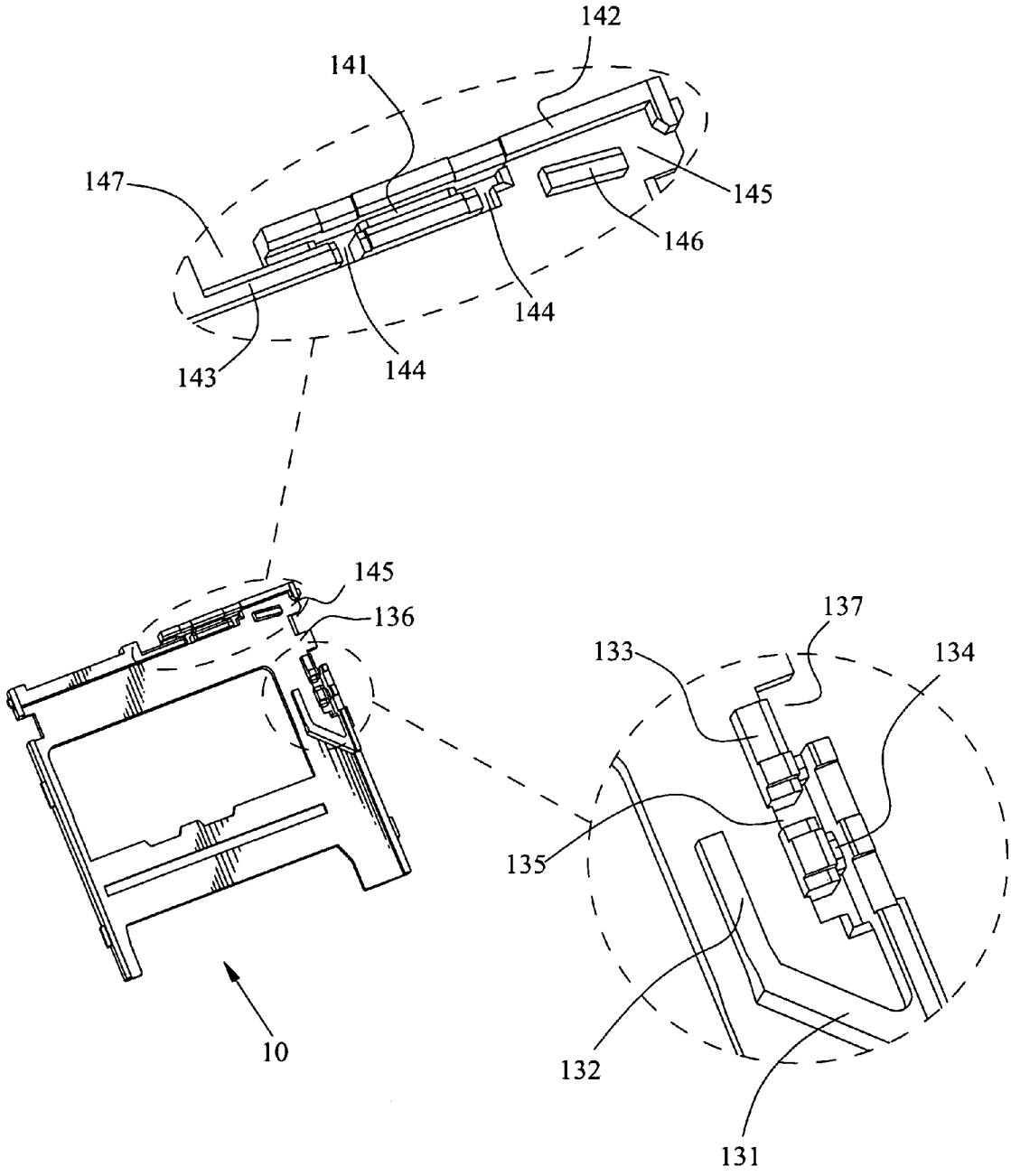
FIG. 3 is a perspective view of an insulating housing shown in FIG. 2, wherein a first receiving recess and a second receiving recess are enlarged.
Figure 4:
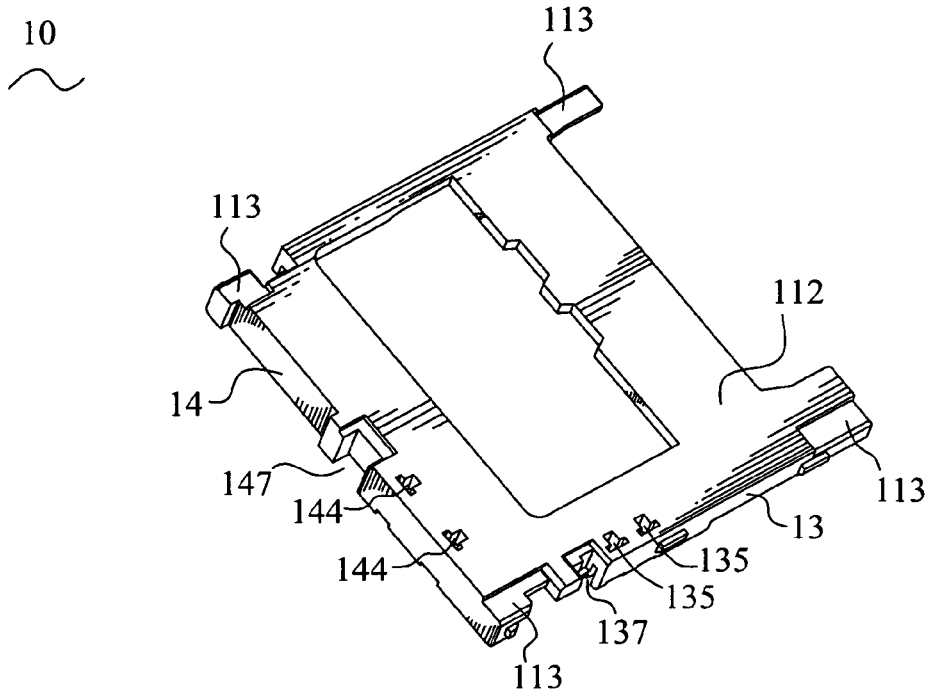
FIG. 4 is a perspective view of the insulating housing shown in FIG. 3 seen from a bottom direction.

Referring to FIG. 1 and FIG. 2, a card connector 1 in accordance with the present invention is shown. The card connector 1 includes an insulating housing 10, a cover 20, a plurality of conductive terminals 30 and a monitoring assembly 40 held in the insulating housing 10 respectively.

Referring to FIGS. 2-4 and FIG. 8, the insulating housing 10 has a rectangular base board 11. The base board 11 defines a top surface 111 and a bottom surface 112 opposite to the top surface 111. Each corner of the bottom surface 112 is formed with a resisting groove 113. Two opposite sides of the base board 11 respectively extend upwards to form a first lateral wall 12 and a second lateral wall 13 facing the first lateral wall 12. Outer surfaces of the first lateral wall 12 and the second lateral wall 13 have portions protruded outwards to form a plurality of locking lumps 114. A rear end of the base board 11 extends upwards to form a preventing wall 14 which connects with the first lateral wall 12 and the second lateral wall 13. A receiving chamber 15 is formed among the first lateral wall 12, the second lateral wall 13, the preventing wall 14 and the base board 11 for receiving a card 2 therein.

An inner surface of the second lateral wall 13 has a portion extended obliquely inwards to form a first stopping wall 131. A free end of the first stopping wall 131 extends towards the preventing wall 14 to form a second stopping wall 132, with a free end thereof spaced away from the preventing wall 14. A side of the top surface 111 adjacent to the second lateral wall 13 has a portion protruded upwards to form a middle wall 133 extending frontward and rearward and apart from the second stopping wall 132, with two ends thereof spaced away from the first stopping wall 131 and the preventing wall 14 respectively. A first receiving recess 134 is formed between the middle wall 133 and the second lateral wall 13. The first receiving recess 134 has two first fixing holes 135 at a bottom thereof, spacing away from each other. Each of the first fixing holes 135 has a middle portion of a side thereof penetrating the middle wall 133 to show a T-shape. The second lateral wall 13 further defines a first opening 136 adjacent to the preventing wall 14. A bottom of the first opening 136 has a first notch 137 reaching the bottom surface 112 of the base board 11, which is located rearward of the first receiving recess 134 and communicates with the first receiving recess 134.

An end of a top of the preventing wall 14 adjacent to the second lateral wall 13 concaves downwards to form a second receiving recess 141, extending along the preventing wall 14 to divide the preventing wall 14 into an outer wall 142 and an inner wall 143. A bottom of the second receiving recess 141 has two second fixing holes 144 spaced from each other. Each of the second fixing holes 144 is substantially same as the first fixing holes 135 and has a middle portion of a side thereof penetrating the inner wall 143 to show a T-shape. The inner wall 143 has a second opening 145 disposed at an end thereof adjacent to the second lateral wall 13 to make the second receiving recess 141 communicate with the receiving chamber 15. A bottom of the second opening 145 has a portion protruded upwards to form a protecting tuber 146 substantially in alignment with the inner wall 143. In this embodiment, the protecting tuber 146 extends obliquely, with an end adjacent to the inner wall 143 approaching the outer wall 142. The outer wall 142 has a second notch 147 passing through the bottom surface 112 of the base board 11. The second notch 147 is arranged at an end of the second receiving recess 141 away from the second opening 145 and communicates with the second receiving recess 141.

Figure 5:
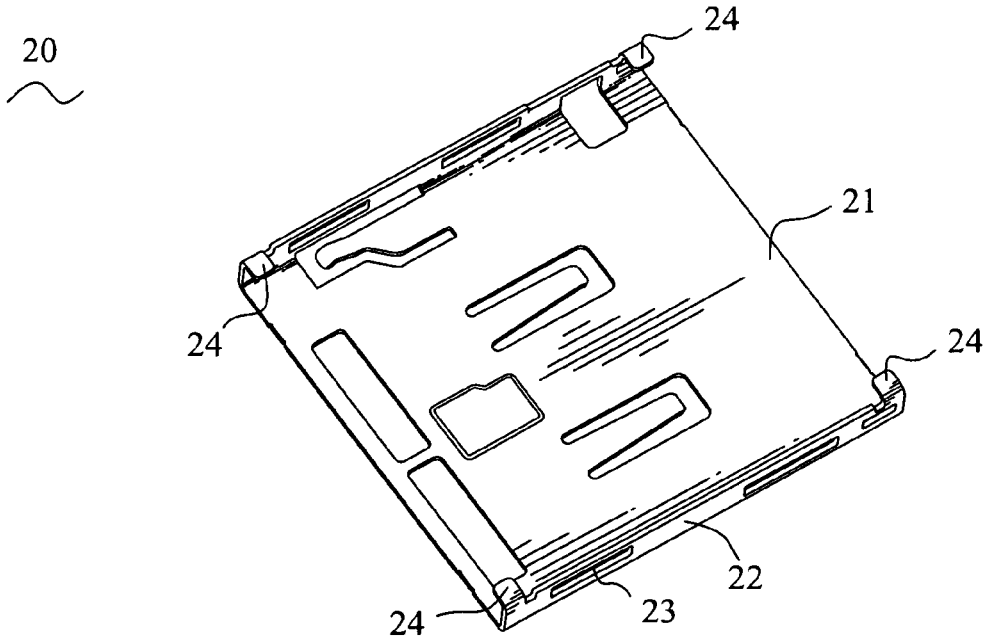
FIG. 5 is a perspective view of a cover of the card connector shown in FIG. 2 seen from a bottom angle.
Figure 6:
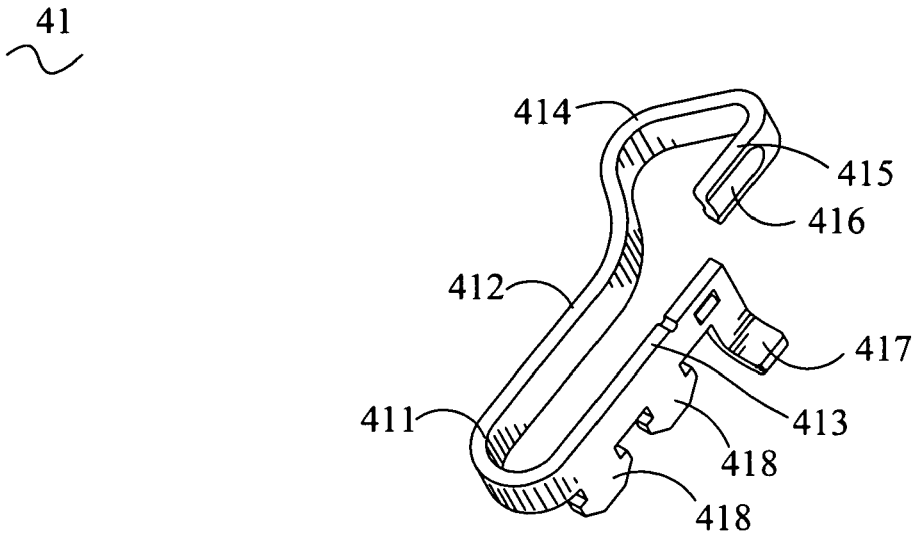
FIG. 6 is a perspective view of a first monitoring member of the card connector shown in FIG. 2.
Figure 7:
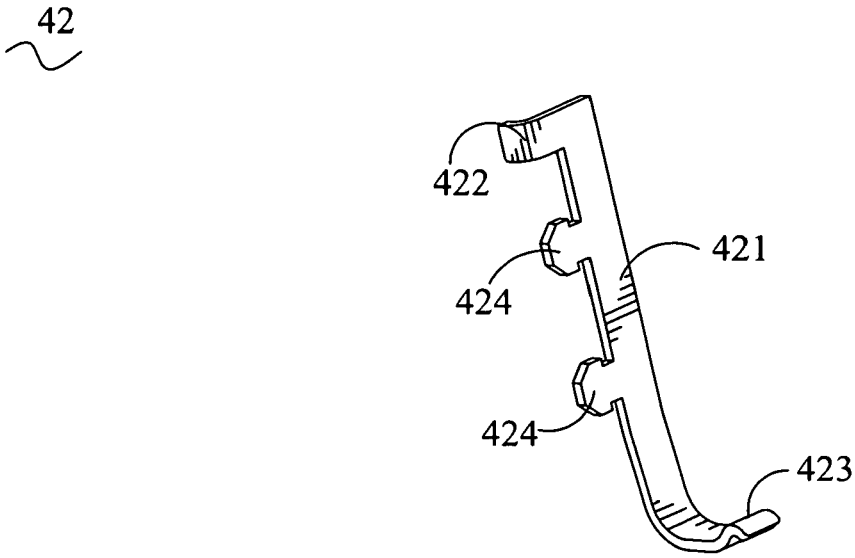
FIG. 7 is a perspective view of a second monitoring member of the card connector shown in FIG. 2.
Figure 8:
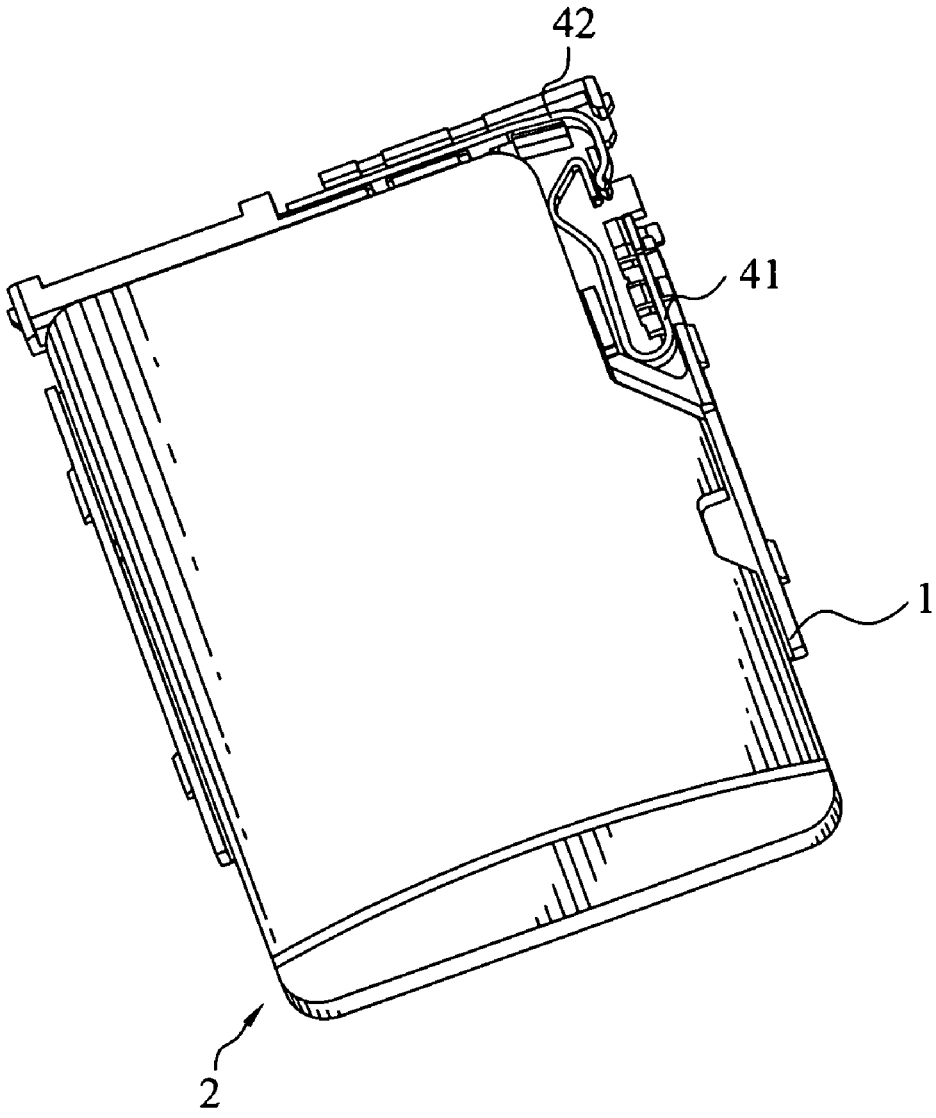
FIG. 8 is a view illustrating a state that the card connector shown in FIG. 1 receives the card, wherein a cover is removed.

Referring to FIG. 2 and FIG. 5, the cover 20 has a rectangular base plate 21. Two opposite sides of the base plate 21 extend downward to form two lateral plates 22. Each of the lateral plates 22 is punched with a plurality of locking holes 23. Two ends of a bottom edge of each of the lateral plates 22 extend inwards to form two buckling slices 24 corresponding with the resisting grooves 113 of the insulating housing 10.

Referring to FIG. 2 to FIG. 7, the monitoring assembly 40 includes a first monitoring member 41 and a second monitoring member 42, which are received in the first receiving recess 134 and the second receiving recess 141 respectively. The first monitoring member 41 has a U-shaped base portion 411. The base portion 411 includes a first arm 412 and a second arm 413, facing each other. The first arm 412 has an elastic portion 414 extended rearwards from an end thereof and arched opposite to the second arm 413 to show substantially smooth V-shape. A free end of the elastic portion 414 is extended towards a substantially middle of the base portion 411 to form a first contacting portion 415. The first contacting portion 415 has an outer surface protruded outwards opposite to the elastic portion 414 to form a protrusion 416. A bottom edge of the second arm 413 has a first soldering portion 417 and two first fixing pegs 418, spaced away from each other. The first soldering portion 417 extends downward and bends opposite to the first arm 412, corresponding to the first notch 137. The first fixing pegs 418 extend downwards corresponding to the first fixing holes 135 of the first receiving recess 134. The second monitoring member 42 of substantially L-shape has a flat connecting strip 421 and a second contacting portion 423 bent frontward and perpendicularly from an end of the connecting strip 421. A bottom edge of the connecting strip 421 has a second soldering portion 422 and two second fixing pegs 424, spaced away from each other. The second soldering portion 422 extends downward and bends rearward, corresponding to the second notch 147. The two second fixing pegs 424 are substantially analogue to the first fixing pegs 418 and extend downwards corresponding with the second fixing holes 144 of the second receiving recess 141.

Referring to FIG. 1 to FIG. 8, in assembly, the conductive terminals 30 are disposed in the insulating housing 10. The second arm 413 of the first monitoring member 41 is fixed into the first receiving recess 134 by means of the first fixing pegs 418 that are restrained in the respective first fixing holes 135. The first arm 412, the elastic portion 414 and the first contacting portion 415 are exposed in the receiving chamber 15. The first soldering portion 417 is arranged in the first notch 137 and extends out of the base board 11 to be soldered with a PCB (not shown). The second fixing pegs 424 abut in the corresponding second fixing holes 144 to fix the connecting strip 421 in the second receiving recess 141. The second contacting portion 423 bypasses the protecting tuber 146 to extend into the receiving chamber 15. The first contacting portion 415 and the second contacting portion 423 face to each other, with a gap left therebetween. The second soldering portion 422 is received into the second notch 147, with an end thereof stretching out of the base board 11 to be soldered to the PCB. The cover 20 is coupled on the insulating housing 10. The locking lumps 114 are buckled with the respective locking holes 23, and the buckling slices 24 are abutted on bottoms of the resisting grooves 113 for fixing the cover 20 to the insulating housing 10.

In use, the card 2 is inserted into the receiving chamber 15 of the card connector 1 to contact the conductive terminals 30. At the same time, the card 2 presses the elastic portion 414 sideward to make the protrusion 416 of the first contacting portion 415 elastically abut against the second contacting portion 423, which forms an electrical connection between the first monitoring member 41 and the second monitoring member 42 to monitor whether the card 2 is fully inserted in the card connector 1.

As described above, the first monitoring member 41 is disposed in the first receiving recess 134, with the first contacting portion 415 exposed in the receiving chamber 15. The connecting strip 421 of the second monitoring member 42 is fixed in second receiving recess 141 of the preventing wall 14, with the second contacting portion 423 stretching in the receiving chamber 15 for abutting against the protrusion 416 of the first contacting portion 415 to monitor whether the card 2 is fully inserted. Such arrangements save an occupied space of the insulating housing 10, consequently, reduce the volume of the card connector 1.

Furthermore, the present invention is not limited to the embodiment described above; various additions, alterations and the like may be made within the scope of the present invention by a person skilled in the art. For example, respective embodiments may be appropriately combined.

What is claimed is:

1. A card connector adapted for receiving a card therein, comprising:

an insulating housing having a base board, a first lateral wall and a second lateral wall extending upwards from two opposite sides of the base board, and a preventing wall extending upwards from a rear end of the base board, a receiving chamber formed thereamong for receiving the card, a side of a bottom of the receiving chamber adjacent to the second lateral wall having a portion extending upwards to form a middle wall;

a plurality of conductive terminals disposed in the insulating housing and contacting the card; and a monitoring assembly disposed in the insulating housing and having a first monitoring member and a second monitoring member, the first monitoring member fixed in the receiving chamber adjacent to the second lateral wall and having a U-shaped base portion and an elastic portion, the base portion defining a first arm and a second arm facing the first arm and adjacent to the second lateral wall, the elastic portion being of substantially smooth V shape with a point back to the second lateral wall for resting against a side of the inserted card, and extending and being arched opposite to the second arm from a free end of the first arm, the second monitoring member mounted in the preventing wall and having a contacting portion extending in parallel with the second lateral wall and located at an outer side of the elastic portion, with a gap formed therebetween;

wherein the elastic portion is pressed laterally by the fully inserted card and deflects elastically to connect with the contacting portion, the middle wall is parallel to the second lateral wall with a first receiving recess formed therebetween for fixing the second arm of the first monitoring member, and a bottom of the first receiving recess has two first fixing holes spaced away from each other, each of the first fixing holes has a middle portion of a side thereof penetrating the middle wall to show a T-shape, a bottom edge of the second arm protrudes downwards to form two first fixing pegs inserted into the respective first fixing holes for fixing the base portion of the first monitoring member in the first receiving recess.

2. The card connector as claimed in claim 1, wherein a free end of the elastic portion is bent toward a middle of the base portion to form a first contacting portion, the first contacting portion is substantially parallel to the first and second arm for resting against the contacting portion.

3. The card connector as claimed in claim 2, wherein the first contacting portion has an outer surface protruded outwards opposite to the elastic portion to form a protrusion.

4. The card connector as claimed in claim 1, wherein a free end of the elastic portion is bent frontward and substantially faces the elastic portion to form a first contacting portion, for resting against the contacting portion.

5. The card connector as claimed in claim 1, wherein the second monitoring member has a flat connecting strip and a second contacting portion bent frontward from an end of the connecting strip, forming a substantially L-shape, the connecting strip is fixed in a receiving recess formed in the preventing wall.

6. The card connector as claimed in claim 5, wherein an end of a top of the preventing wall adjacent to the second lateral wall is recessed downwards to form the receiving recess, the receiving recess extends along the preventing wall and divides the corresponding preventing wall into an outer wall and an inner wall.

7. The card connector as claimed in claim 6, wherein the receiving recess has two fixing holes at a bottom thereof, each of the fixing holes has a middle portion of a side thereof penetrating the inner wall to show a T-shape, a bottom edge of the connecting strip extends downward to form two fixing pegs corresponding with the fixing holes, for fixing the second monitoring member in the receiving recess.

8. The card connector as claimed in claim 1, further comprising a cover coupled with the insulating housing, the cover having a base plate, and two lateral plates extending downwards from two opposite sides of the base plate, the lateral plates having a plurality of locking holes for engaging with a plurality of locking lumps protruded outwards from the first and second lateral wall, respectively.

9. The card connector as claimed in claim 8, wherein a bottom edge of each of the lateral plates is bent inwards to form a plurality of buckling slices clasping a bottom of the base board.

10. A card connector adapted for receiving a card therein, comprising:

an insulating housing having a base board, a first lateral wall and a second lateral wall extending upwards from two opposite sides of the base board, and a preventing wall extending upwards from a rear end of the base board, a receiving chamber formed thereamong for receiving the card;

a plurality of conductive terminals disposed in the insulating housing and contacting the card; and a monitoring assembly disposed in the insulating housing and having a first monitoring member and a second monitoring member, the first monitoring member fixed in the receiving chamber adjacent to the second lateral wall and having a U-shaped base portion and an elastic portion, the base portion defining a first arm and a second arm facing the first arm and adjacent to the second lateral wall, the elastic portion being of substantially smooth V shape with a point back to the second lateral wall for resting against a side of the inserted card, and extending and being arched opposite to the second arm from a free end of the first arm, the second monitoring member mounted in the preventing wall and having a contacting portion extending in parallel with the second lateral wall and located at an outer side of the elastic portion, with a gap formed therebetween;

wherein a free end of the elastic portion is bent toward a middle of the base portion to form a first contacting portion, the first contacting portion is substantially parallel to the first and second arm for resting against the contacting portion and has an outer surface protruding outwards opposite to the elastic portion to form a protrusion, and the elastic portion is pressed laterally by the fully inserted card and deflects elastically to connect with the contacting portion.

11. The card connector as claimed in claim 10, wherein a side of a bottom of the receiving chamber adjacent to the second lateral wall has a portion extending upwards to form a middle wall, the middle wall is parallel to the second lateral wall, with a first receiving recess formed therebetween for fixing the second arm of the first monitoring member.

12. The card connector as claimed in claim 10, wherein a free end of the elastic portion is bent frontward and substantially faces the elastic portion to form a first contacting portion, for resting against the contacting portion.

13. The card connector as claimed in claim 10, wherein the second monitoring member has a flat connecting strip and a second contacting portion bent frontward from one end of the connecting strip, forming a substantially L-shape, the connecting strip is fixed in a receiving recess formed in the preventing wall.

14. The card connector as claimed in claim 10, further comprising a cover coupled with the insulating housing, the cover having a base plate, and two lateral plates extending downwards from two opposite sides of the base plate, the lateral plates having a plurality of locking holes for engaging with a plurality of locking lumps protruding outwards from the first and the second lateral walls, respectively.

15. A card connector adapted for receiving a card therein, comprising:

an insulating housing having a base board, a first lateral wall and a second lateral wall extending upwards from two opposite sides of the base board, and a preventing wall extending upwards from a rear end of the base board, a receiving chamber formed thereamong for receiving the card;

a plurality of conductive terminals disposed in the insulating housing and contacting the card; and a monitoring assembly disposed in the insulating housing and having a first monitoring member and a second monitoring member, the first monitoring member fixed in the receiving chamber adjacent to the second lateral wall and having an elastic portion of substantially smooth V shape with a point back to the second lateral wall for resting against a side of the inserted card, the second monitoring member mounted in the preventing wall and having a contacting portion extending in parallel with the second lateral wall and located at an outer side of the elastic portion, with a gap formed therebetween;

wherein a free end of the elastic portion is bent frontward and substantially faces the elastic portion to form a first contacting portion, and the elastic portion is pressed laterally by the fully inserted card and deflects elastically to enable the first contacting portion resting against the contacting portion of the second monitoring member.

16. The card connector as claimed in claim 15, wherein the first monitoring member has a U-shaped base portion, defining a first arm and a second arm facing the first arm and adjacent to the second lateral wall, and the elastic portion extends and is arched opposite to the second arm from a free end of the first arm.

17. The card connector as claimed in claim 16, wherein a side of a bottom of the receiving chamber adjacent to the second lateral wall has a portion extending upwards to form a middle wall, the middle wall is parallel to the second lateral wall, with a first receiving recess formed therebetween for fixing the second arm of the first monitoring member.

18. The card connector as claimed in claim 16, wherein a free end of the elastic portion is bent toward a middle of the base portion to form a first contacting portion, and the first contacting portion is substantially parallel to the first and second arm for resting against the contacting portion.

19. The card connector as claimed in claim 15, wherein the second monitoring member has a flat connecting strip and a second contacting portion bent frontward from one end of the connecting strip, forming a substantially L-shape, the connecting strip is fixed in a receiving recess formed in the preventing wall.

20. The card connector as claimed in claim 15, further comprising a cover coupled with the insulating housing, the cover having a base plate, and two lateral plates extending downwards from two opposite sides of the base plate, the lateral plates having a plurality of locking holes for engaging with a plurality of locking lumps protruding outwards from the first and the second lateral walls, respectively.

* * * * *